US009142180B2

(12) United States Patent
Yang et al.

(10) Patent No.: US 9,142,180 B2
(45) Date of Patent: Sep. 22, 2015

(54) DISPLAY APPARATUS FOR ADJUSTING A GRAY VALUE OF AN IMAGE SIGNAL

(71) Applicant: Samsung Display Co., Ltd., Yongin, Gyeonggi-Do (KR)

(72) Inventors: Ji-Yeon Yang, Yongin (KR); Won-Woo Jang, Yongin (KR); Geun-Young Jeong, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 213 days.

(21) Appl. No.: 13/652,141

(22) Filed: Oct. 15, 2012

(65) Prior Publication Data

US 2013/0257915 A1 Oct. 3, 2013

(30) Foreign Application Priority Data

Mar. 27, 2012 (KR) ..... 10-2012-0031173

(51) Int. Cl.
*G09G 3/36* (2006.01)
*G09G 3/20* (2006.01)

(52) U.S. Cl.
CPC ..... *G09G 3/3688* (2013.01); *G09G 3/2044* (2013.01); *G09G 2310/0232* (2013.01); *G09G 2320/0233* (2013.01); *G09G 2320/0276* (2013.01); *G09G 2340/0457* (2013.01)

(58) Field of Classification Search
CPC ..... G09G 3/3685
USPC ..... 345/89
See application file for complete search history.

(56) References Cited

U.S. PATENT DOCUMENTS

| | | | | |
|---|---|---|---|---|
| 7,362,338 | B1 * | 4/2008 | Gettemy et al. | 345/698 |
| 2002/0054253 | A1 * | 5/2002 | Cho et al. | 349/110 |
| 2002/0190973 | A1 * | 12/2002 | Morita | 345/204 |
| 2007/0035557 | A1 * | 2/2007 | Choe et al. | 345/613 |
| 2007/0109468 | A1 * | 5/2007 | Oku | 349/110 |
| 2007/0146518 | A1 * | 6/2007 | Hong et al. | 348/308 |
| 2009/0073099 | A1 * | 3/2009 | Yeates et al. | 345/87 |
| 2010/0149204 | A1 * | 6/2010 | Han | 345/84 |
| 2011/0037784 | A1 * | 2/2011 | Shiomi | 345/690 |
| 2011/0221332 | A1 * | 9/2011 | Jeon et al. | 313/504 |
| 2011/0279487 | A1 * | 11/2011 | Imamura et al. | 345/102 |
| 2012/0162156 | A1 * | 6/2012 | Chen et al. | 345/87 |

FOREIGN PATENT DOCUMENTS

| | | |
|---|---|---|
| KR | 10-2010-0045657 A | 5/2010 |
| KR | 10-2010-0070872 A | 6/2010 |
| KR | 10-2011-0101769 A | 9/2011 |

* cited by examiner

*Primary Examiner* — Adam J Snyder
(74) *Attorney, Agent, or Firm* — Knobbe, Martens, Olson & Bear, LLP

(57) ABSTRACT

A display apparatus having improved display quality is disclosed. According to one aspect, the display apparatus includes a display panel including first to Mth data lines extending in a first direction, where M is an integer greater than 2, first to Nth scan lines extending in a second direction, where N is an integer greater than 2, and a plurality of pixel regions defined by one or more of the data lines and one or more of the scan lines. An image data processor is configured to process input image signals and output corrected input image signals, and a data driver is configured to receive the corrected input image signals and supply the same to the first to Mth data lines. The plurality of pixel regions include first to Mth pixel arrays extending in parallel, and the image data signal processor is configured to output the corrected input image signals to adjust a gray value applied to at least one of the first pixel array and the Mth pixel array.

17 Claims, 11 Drawing Sheets

DISPLAY APPARATUS FOR ADJUSTING A GRAY VALUE OF AN IMAGE SIGNAL

CROSS-REFERENCE TO RELATED APPLICATIONS

This application claims priority from Korean Patent Application No. 10-2012-0031173 filed on Mar. 27, 2012 in the Korean Intellectual Property Office, the disclosure of which is incorporated herein by reference in its entirety.

BACKGROUND

1. Field

The disclosed technology generally relates to a display apparatus, and more particularly, to a display apparatus having improved display quality.

2. Description of the Related Technology

Recently, the demand for thin and lightweight monitors, televisions, and portable display devices has increased. In response to the demand, flat panel displays, such as a liquid crystal displays, are rapidly replacing the conventional cathode ray tube (CRT) display.

The flat panel displays, such as liquid crystal displays, include a display area having a plurality of pixels and a non-display area surrounding and defining the display area. The non-display area includes a light-shielding material, such as a black matrix.

In a flat panel display, such as a liquid crystal display, the leftmost and rightmost pixel arrays are directly adjacent to a black matrix of a non-display area. In some instances, the pixel arrays provided in the leftmost and rightmost sides of the display area can be perceived more noticeably by the eye relative to surrounding pixel arrays. For example, when an edge area of display areas adjacent to the non-display area is configured to display a fully white image, display areas can be perceived more noticeably. Accordingly, since the color of the pixel array is perceived by user's eyes, vertical striped patterns may be seen in the leftmost and rightmost pixel arrays of the display area.

SUMMARY OF CERTAIN INVENTIVE ASPECTS

According to one aspect, a display apparatus is disclosed. The display apparatus includes a display panel including first to Mth data lines extending in a first direction, where M is an integer greater than 2, first to Nth scan lines extending in a second direction, where N is an integer greater than 2, and a plurality of pixel regions defined by one or more of the data lines and one or more of the scan lines, an image data processor configured to process input image signals and output corrected input image signals, and a data driver configured to receive the corrected input image signals and supply the corrected input image signals to the data lines. The plurality of pixel regions include first to Mth pixel arrays extending in parallel, and the image data signal processor is configured to output the corrected input image signals to adjust a gray value applied to the first pixel array.

According to one aspect, a display apparatus is disclosed that includes a display panel including first to Mth data lines extending in a first direction, where M is an integer greater than 2, first to Nth scan lines extending in a second direction, where N is an integer greater than 2, and a plurality of pixel regions defined by one or more of the data lines and one or more of the scan lines, an image data processor configured to process input image signals and output corrected input image signals, and a data driver configured to receive the corrected input image signals and supply the corrected input image signals to the data lines. The plurality of pixel regions include first to Mth pixel arrays extending in parallel, and the image data signal processor is configured to output the corrected input image signals to adjust a gray value applied to the Mth pixel array.

According to one aspect, a display apparatus is disclosed that includes a display panel including first to Mth data lines extending in a first direction, where M is an integer greater than 2, first to Nth scan lines extending in a second direction, where N is an integer greater than 2, and a plurality of pixel regions defined by one or more of the data lines and one or more of the scan lines, an image data processor configured to process input image signals and output corrected input image signals, and a data driver configured to receive the corrected input image signals and supply the corrected input image signals to the data lines. The plurality of pixel regions include first to Mth pixel arrays extending in parallel, and the image data signal processor is configured to output the corrected input image signals to adjust gray values applied to the first to Mth pixel arrays.

According to one aspect, a display apparatus is disclosed that includes a display panel including first to Mth data lines extending in a first direction, where M is an integer greater than 2, first to Nth scan lines extending in a second direction, where N is an integer greater than 2, and a plurality of pixel regions defined by one or more of the data lines and one or more of the scan lines, an image data processor configured to process input image signals and output corrected input image signals, and a data driver configured to receive the corrected input image signals and supply the corrected input image signals to the data lines, a first voltage adjusting unit connected to the first data line between the data driver and the plurality of pixel regions, and a second voltage adjusting unit connected to the Mth data line between the data driver and the plurality of pixel regions. The plurality of pixel regions include first to Mth pixel arrays extending in parallel, and the image data signal processor is configured to output a first vertical edge control signal to adjust a gray value applied to the first pixel array and a second vertical edge control signal to adjust a gray value applied to the Mth pixel array, the first voltage adjusting unit is configured to receive the first vertical edge control signal and adjust a gray voltage of the first data line, the second voltage adjusting unit is configured to receive the second vertical edge control signal and adjust a gray voltage of the Mth data line.

BRIEF DESCRIPTION OF THE DRAWINGS

The above and other features and advantages of the present invention will become more apparent by describing in detail some embodiments thereof with reference to the attached drawings in which.

DETAILED DESCRIPTION OF CERTAIN INVENTIVE EMBODIMENTS

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will filly convey the scope of the invention to those skilled in the art. The same reference numbers indicate the same components throughout the specification. In the attached figures, the thickness of layers and regions is exaggerated for clarity.

Hereinafter, the present invention will be described in further detail with reference to the accompanying drawings.

Figure 1:
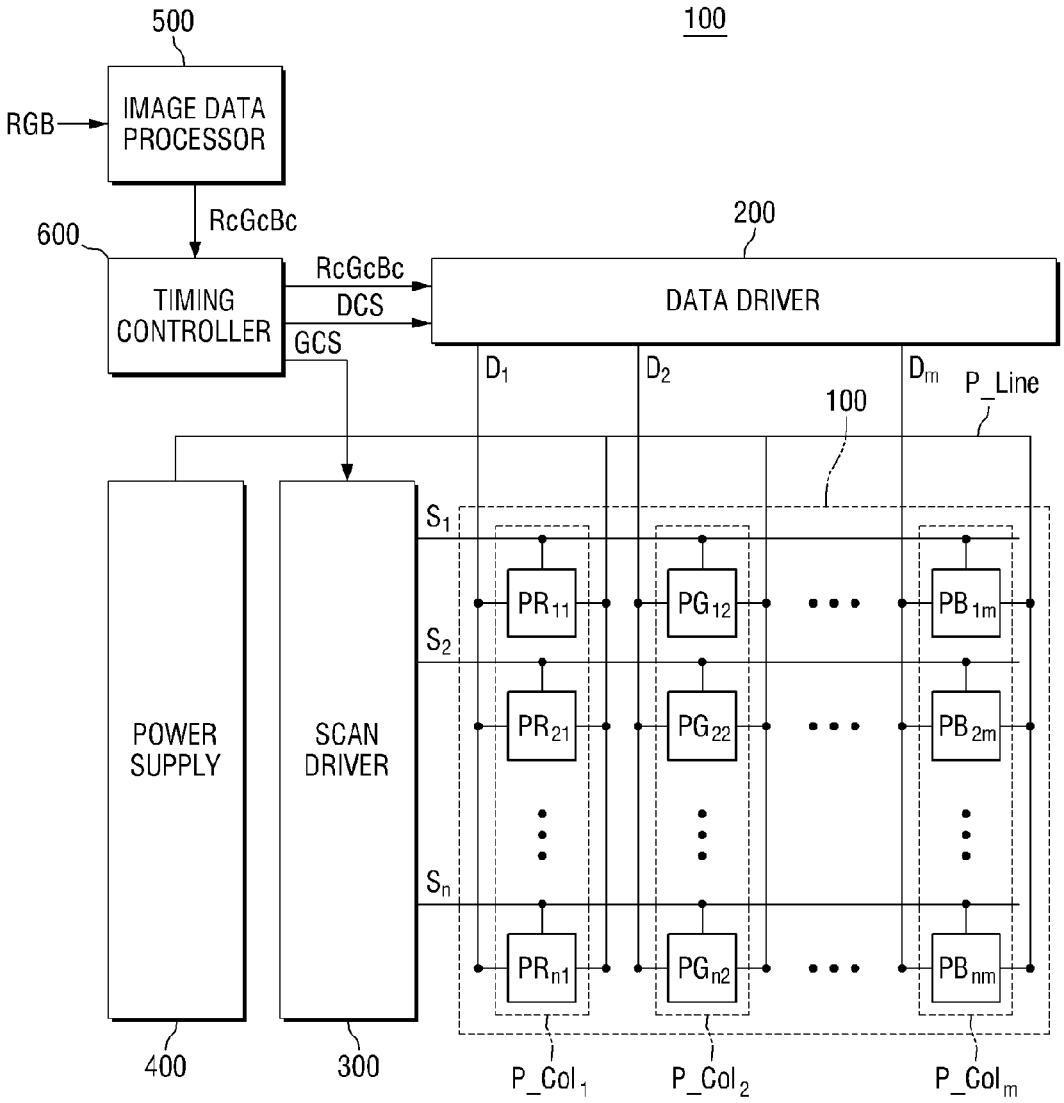
FIG. 1 is a block diagram of a display apparatus according to some embodiments.

FIG. 1 is a block diagram of a display apparatus according to some embodiments.

Referring to FIG. 1, the display apparatus according to some embodiments includes a display panel 100, a data driver 200, a scan driver 300, a power supply 400, an image data processor 500 and a timing controller 600.

The display panel 100 includes first to Nth scan lines (S1, S2, . . . , Sn) extending in a horizontal direction and transmitting scan signals, first to Mth data lines (D1, D2, . . . , Dm) extending in a vertical direction and transmitting data signals to a plurality of pixel regions in response to the scan signals from the first to Nth scan lines (S1, S2, . . . , Sn), a plurality of pixel regions ($PR_{11}$, $PG_{12}$, . . . $PB_{nm}$) defined by the first to Mth data lines (D1, D2, . . . , Dm) and the first to Nth scan lines (S1, S2, . . . , Sn), and a drive voltage supply line (P-Line) supplying a drive current or drive voltage to the plurality of pixel regions.

The plurality of pixel regions may include a first pixel array having first pixels configured to display a red color arranged in parallel, a second pixel array having second pixels configured to display a green color arranged in parallel, and a third pixel array (not shown) having third pixels configured to display a blue color arranged in parallel. The plurality of pixel regions includes a (M−2)th pixel array, a (M−1)th pixel array and an Mth pixel array each configured to display the same color as that of each of the first pixel array, the second pixel array and the third pixel array, so that the display panel 100 may have the plurality of pixel regions arranged in RGB stripe shapes in which pixel arrays configured to display RGB colors are sequentially arrayed.

The image data processor 500 receives the input image signals output from an image source (not shown), processes the received input image signals and outputs corrected input image signals.

The image data processor 500 may generate a corrected image signal by rendering or dithering the input image signals for a display image according to user's signals or device characteristics of the display apparatus.

For example, in the display apparatus according to some embodiments, the image data processor 500 adjusts a gray value of an image signal applied to the first pixel array (P_Col1) or the Mth pixel array (P_Colm) and outputs corrected input image signals (RcGcBc) which can correct vertical striped patterns generated when a color of the first pixel array (P_Col1) or the Mth pixel array (P_Colm) is markedly perceived.

The timing controller 600 may receive the corrected input image signals (RcGcBc) output from the image data processor 500 and may transmit the corrected input image signals (RcGcBc) to the data driver 200. The timing controller 600, synchronized with the corrected input image signals (RcGcBc), may output a data control signal (DCS) and a scan driving signal for driving the data driver 200 and the scan driver 300.

As shown in FIG. 1, the image data processor 500 and the timing controller 600 are illustrated as separate functional blocks, but aspects of the present invention are not limited thereto. The image data processor 500 and the timing controller 600 may be a single functional module performing various functions, and may be mounted together in a single IC chip.

As discussed above with reference to FIG. 1, the timing controller 600 receives the corrected input image signals (RcGcBc) output from the image data processor 500 and transmits the same to the data driver 200 without further adjustment. Aspects of the present invention are not limited thereto. According to some embodiments, the timing controller 600 may receive the corrected input image signals (RcGcBc), re-correct the corrected input image signals (RcGcBc) and then transmit the re-corrected signal to the data driver 200.

The data driver 200 may receive the corrected input image signals (RcGcBc) and the data control signal (DCS) supplied from the timing controller 600 and may supply the same to the first to Mth data lines. Although not shown in FIG. 1, the data driver 200 may include a latch circuit and a level shifter circuit. The latch circuit may store corrected input image signals (RcGcBc) received in series to apply data signals in parallel to the display panel 100. The level shifter circuit may adjust a level of an actual voltage applied to the display panel 100. Different configurations of the latch circuit and the level shifter circuit may be readily apparent to one skilled in the art to which the present invention pertains.

The scan driver 300 may receive a scan control signal (SCS) supplied from the timing controller 600 and may apply a scan signal to the first to Nth scan lines (S1, S2, . . . , Sn). The scan signal functions as a switch to allow the data signal applied through the data lines (D1, D2, . . . , Dm) to be applied to pixel electrode (not shown) of the plurality of pixels.

The image data processor 500 of the display apparatus according to some embodiments will be described in detail with reference to FIGS. 2 and 3.

Figure 2:
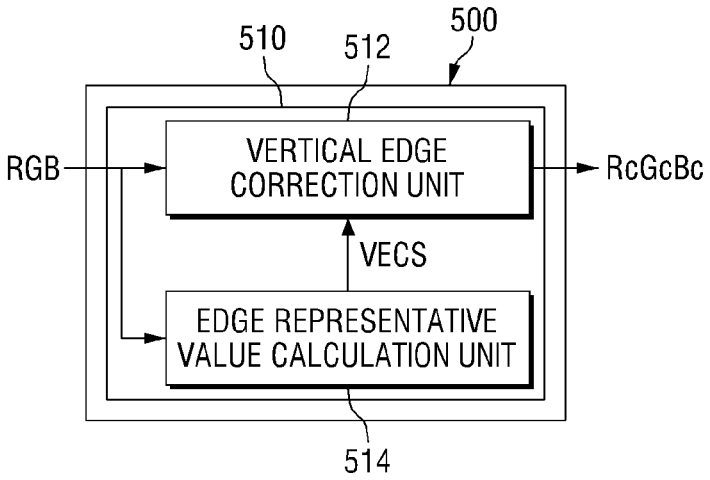
FIG. 2 is a block diagram illustrating a configuration of an image data processor of the display apparatus shown in FIG. 1.

FIG. 2 is a block diagram illustrating a configuration of an image data processor of the display apparatus shown in FIG. 1. FIG. 3 is a plan view illustrating a display example of a still image displayed on the display apparatus shown in FIG. 1.

Referring to FIG. 2, the image data processor 500 according to some embodiments may include a vertical edge processor 510. The vertical edge processor 510 may include a vertical edge correction unit 512 and an edge representative value calculation unit 514.

The edge representative value calculation unit 514 analyzes the received input image signals (RGB), outputs a vertical edge control signal (VECS) and supplies the same to the vertical edge correction unit 512.

The vertical edge correction unit 512 may output corrected input image signals (RcGcBc) to adjust a gray value of the first pixel array (P_Col1) or the Mth pixel array (P_Colm) based on the supplied vertical edge control signal (VECS).

Figure 3:
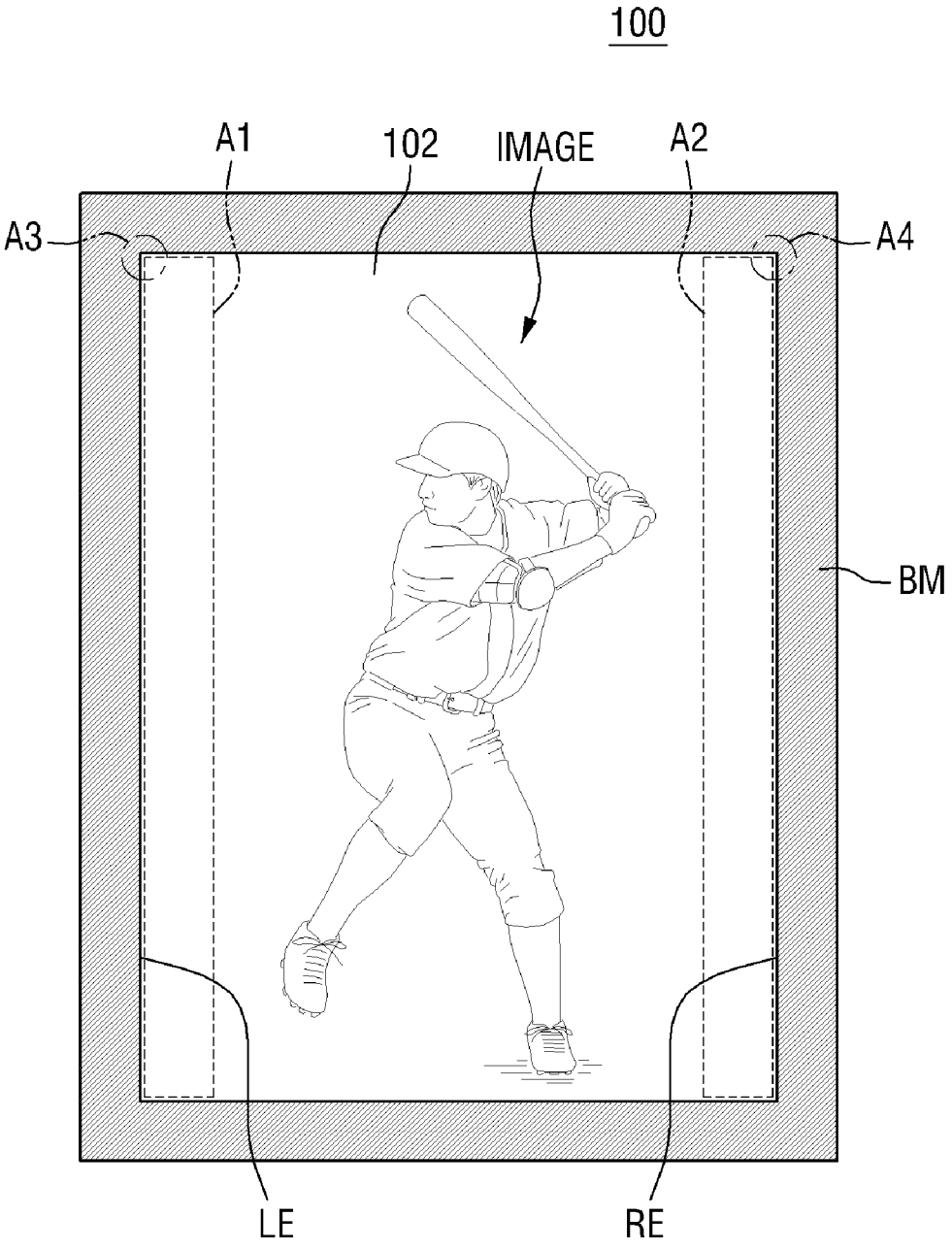
FIG. 3 is a plan view illustrating a display example of a still image displayed on the display apparatus shown in FIG. 1.

Referring to FIG. 3, the display panel 100 may include a display area 102 having the plurality of pixel regions to display an image and a black matrix (BM) shaped to surround the display area 102. The black matrix (BM) may be formed of a light-shielding material to absorb light.

As shown in FIG. 3, under a general web browsing environment, a display image (IMAGE) may be displayed such that an achromatic colored background is displayed on left and right outer regions of the display image (IMAGE) and a photograph or a text is displayed on a central portion of the screen. For example, when the left and right outer regions of the display image (IMAGE) are fully white colored, colors of pixel arrays adjacent to the black matrix (BM) and the left and right edges (LE, RE) of the display area 102 may be markedly perceived in contrast with the black matrix (BM). Accordingly, vertical striped patterns may be perceived in the pixel arrays adjacent to the left and right edges (LE, RE).

The edge representative value calculation unit 514 may calculate an average gray value of the pixel regions in a first edge area (A1) adjacent to the black matrix (BM) and the left edge LE of the display area 102 or a second edge area (A2) adjacent to the black matrix (BM) and the right edge RE of the display area 102, and may output a vertical edge control signal (VECS) based on the average gray value. For example, the edge representative value calculation unit 514 may generate the vertical edge control signal (VECS) having a minimum value when the average gray value of the plurality of pixel regions in the first edge area (A1) or the second edge area (A2) is a gray colored image having a predetermined gray value, and having a maximum value when the average gray value of the plurality of pixel regions in the first edge area (A1) or the second edge area (A2) is a fully white colored image. As will be appreciated by one of ordinary skill in the art, aspects of the present invention are not limited thereto. The edge representative value calculation unit 514 may generate a logic signal simply determining whether the average gray value of the plurality of pixel regions in the first edge area (A1) or the second edge area (A2) exceeds the predetermined critical gray value.

Figure 4:
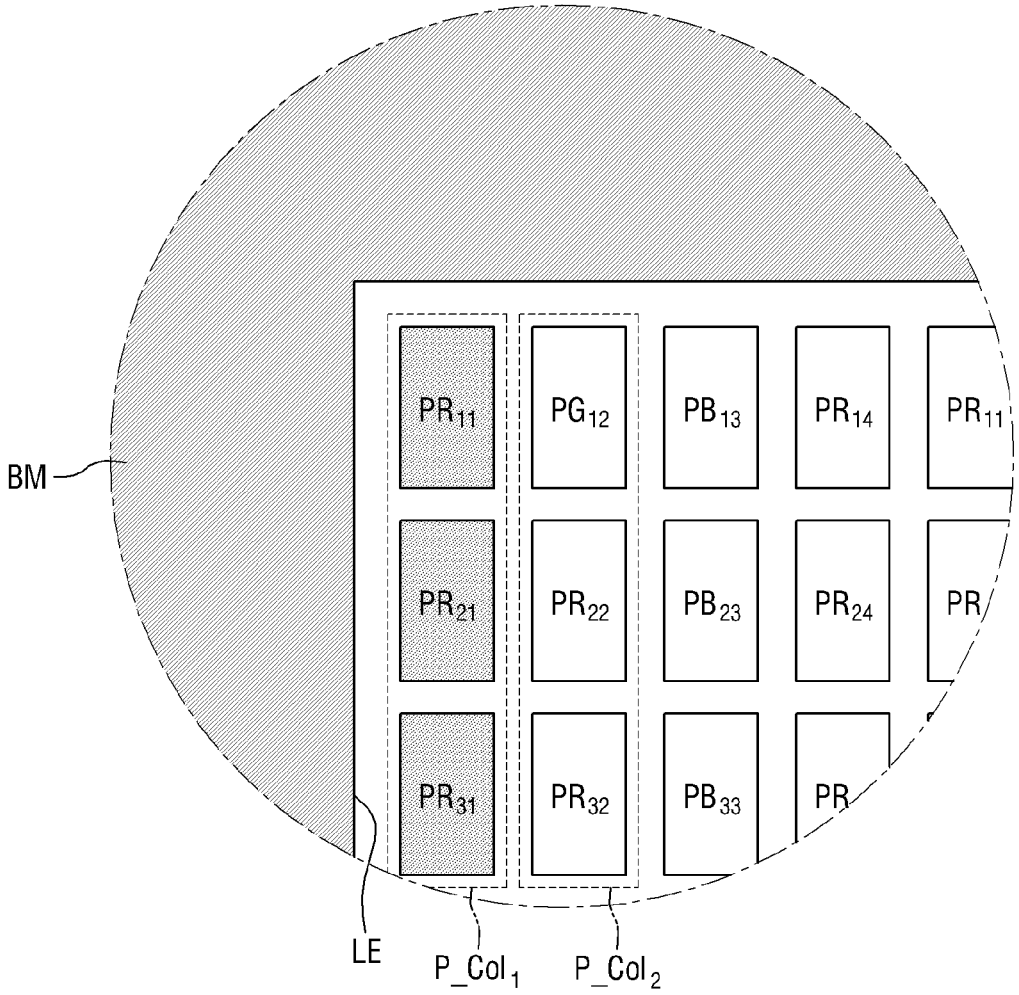
FIG. 4 is an enlarged cross-sectional view of area A3 of FIG. 3.

FIG. 4 is an enlarged cross-sectional view of area A3 of FIG. 3.

Referring to FIGS. 3 and 4, with respect to the input image signals (RGB) corresponding to the display image (IMAGE) shown in FIG. 3, the edge representative value calculation unit 514 may calculate the average gray value of the first edge area (A1), may determine whether the first edge area (A1) of the display image (IMAGE) shown in FIG. 3 is a fully white image or a gray colored image exceeding the predetermined critical gray value, and may output the vertical edge control signal (VECS) according to the determination result.

The vertical edge correction unit 512 receives the vertical edge control signal (VECS) and outputs the corrected input image signals (RcGcBc) to adjust a gray value applied to the first pixel array (P_Col1) adjacent to the left edge (LE), which is then applied to the data line of the first pixel array (P_Col1) via the data driver 200, thereby adjusting the gray level of the first pixel array (P_Col1).

The vertical edge correction unit 512 may vary an adjustment extent of the gray level of the first pixel array (P_Col1) according to the size or logic value of the vertical edge control signal (VECS). For example, the original gray value may be adjusted to one of ¾, ½ or ¼ of the original value according to the size or logic value of the vertical edge control signal (VECS).

Accordingly, the overall gray level of the first pixel array (P_Col1) may be lowered and a contrast ratio of the black matrix (BM) to the first pixel array (P_Col1) is reduced, so that the first pixel array (P_Col1) is markedly perceived, thereby preventing the first pixel array (P_Col1) from being perceived as red striped patterns.

As shown in FIG. 4, the vertical edge correction unit 512, according to some embodiments, adjusts only the gray level of the first pixel array (P_Col1), but aspects of the present invention are not limited thereto. The vertical edge correction unit 512, according to some embodiments, may adjust gray values of the pixel arrays in the area adjacent to the black matrix (BM), including the first pixel array (P_Col1) and the second pixel array (P_Col2) such that the gray values increase from the left edge (LE) of the black matrix (BM) to the first pixel array (P_Col1) and the second pixel array (P_Col2).

Figure 5:
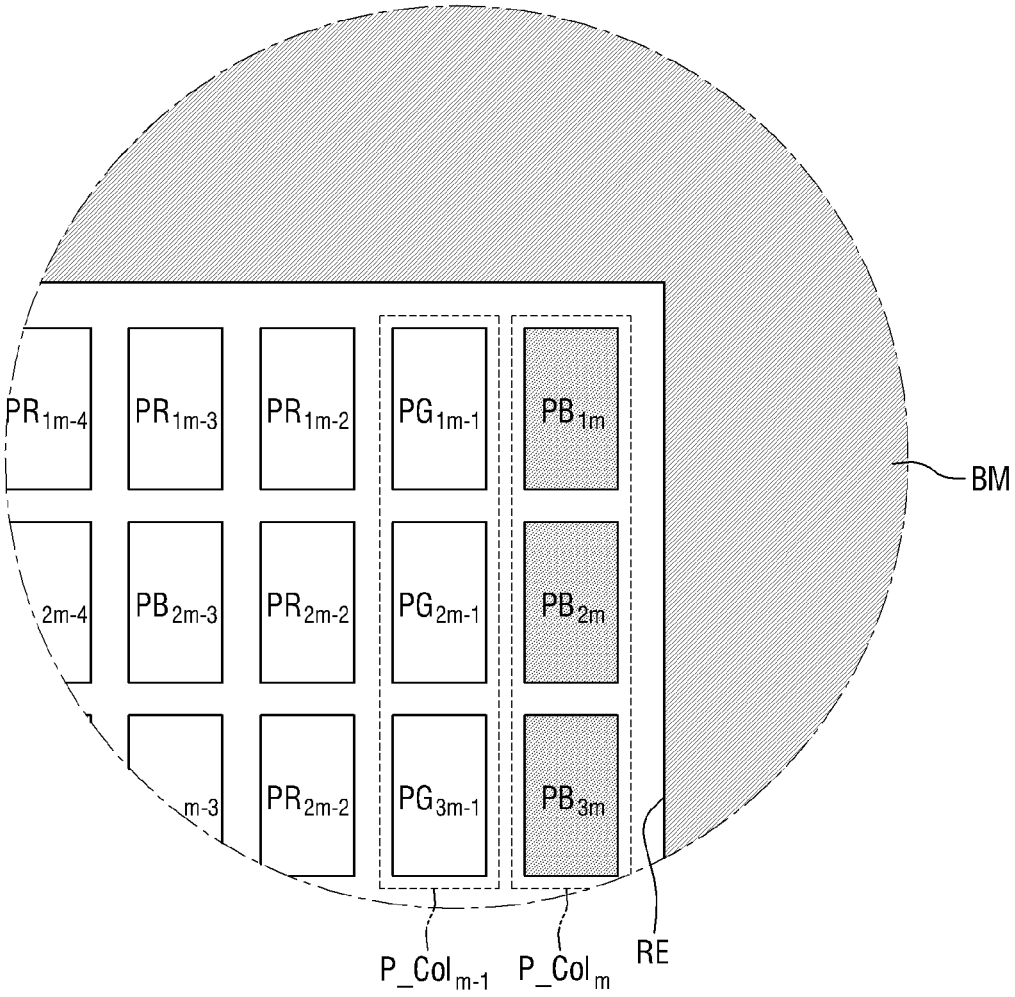
FIG. 5 is an enlarged cross-sectional view of area A4 of FIG. 3.

FIG. 5 is an enlarged cross-sectional view of area A4 of FIG. 3.

Referring to FIGS. 3 and 5, with respect to the input image signals (RGB) corresponding to the display image (IMAGE) shown in FIG. 3, the edge representative value calculation unit 514 may calculate the average gray value of the second edge area (A2) of the display image (IMAGE) shown in FIG. 3, may determine whether the second edge area (A2) is a fully white image, and may output the vertical edge control signal (VECS) corresponding to a full white state.

The vertical edge correction unit 512 receives the vertical edge control signal (VECS) and outputs the corrected input image signals (RcGcBc) to adjust a gray value applied to the Mth pixel array (P_Colm) adjacent to the right edge (RE), which is then applied to the data line of the Mth pixel array (P_Colm) via the data driver 200, thereby adjusting the gray level of the Mth pixel array (P_Colm) and preventing the Mth pixel array (P_Colm) from being perceived as blue striped patterns.

Hereinafter, repeated descriptions of substantially the same configurations and functions of the vertical edge correction unit 512 adjusting the gray values of the pixel arrays adjacent to the left edge (LE) shown in FIG. 4 and the edge representative value calculation unit 514 will be omitted.

Figure 6:
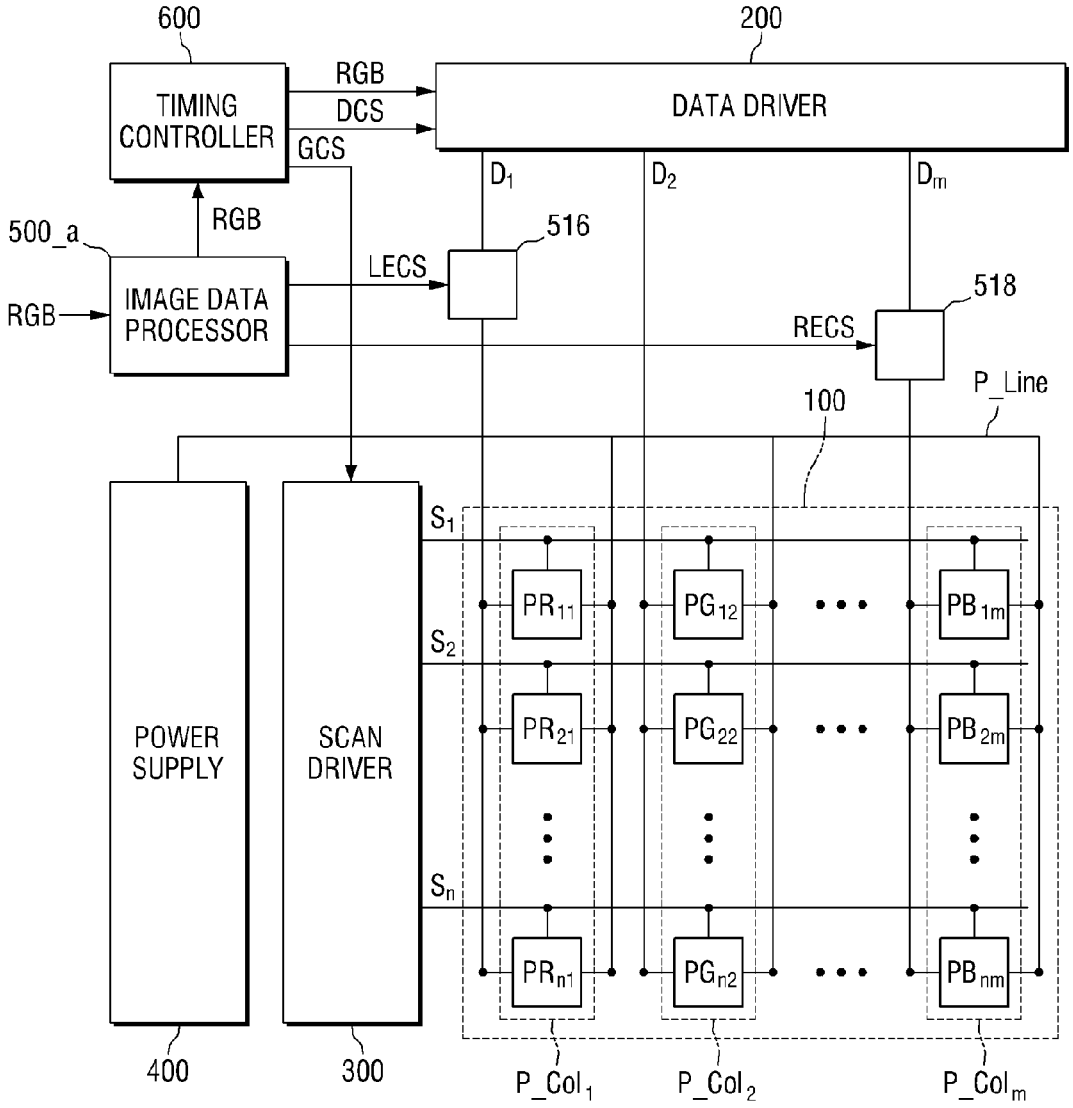
FIG. 6 is a block diagram of a display apparatus according to some embodiments.

FIG. 6 is a block diagram of a display apparatus according to some embodiments.

The display apparatus shown in FIG. 6 is different from the display apparatus of FIG. 1 in that it further includes a first voltage adjusting unit 516 that is configured to receive a first vertical edge control signal (LECS) from an image data processor 500_*a* and a second voltage adjusting unit 518 receiving a second vertical edge control signal (RECS) from the image data processor 500_*a*. In the following description, the components having substantially the same function as those in the previous embodiments are denoted by the same reference symbols or numerals, and repeated descriptions thereof will be omitted.

In the display apparatus according to some embodiments, the image data processor 500_*a* may output the first vertical edge control signal (LECS) to adjust the gray value of the first pixel array (P_Col1) and the second vertical edge control signal (RECS) to adjust the gray value of the Mth pixel array (P_Colm) to then supply the same to the first voltage adjusting unit 516 and the second voltage adjusting unit 518.

The first voltage adjusting unit 516 may be connected to the first data line (D1) between the data driver 200 and the display panel 100 and may receive the first vertical edge control signal (LECS) to adjust a gray voltage of the first data line (D1).

The second voltage adjusting unit 518 may be connected to the Mth data line (Dm) between the data driver 200 and the display panel 100 and may receive the second vertical edge control signal (RECS) to adjust a gray voltage of the Mth data line (Dm).

The first voltage adjusting unit 516 and the second voltage adjusting unit 518 may be implemented as circuits capable of adjusting the gray voltage of the first data line (D1) or the Mth data line in response to the first vertical edge control signal (LECS) or the second vertical edge control signal (RECS). For example, the first voltage adjusting unit 516 and/or the second voltage adjusting unit 518 may be a voltage division circuit switched by the first vertical edge control signal (LECS) or the second vertical edge control signal (RECS).

Figure 7:
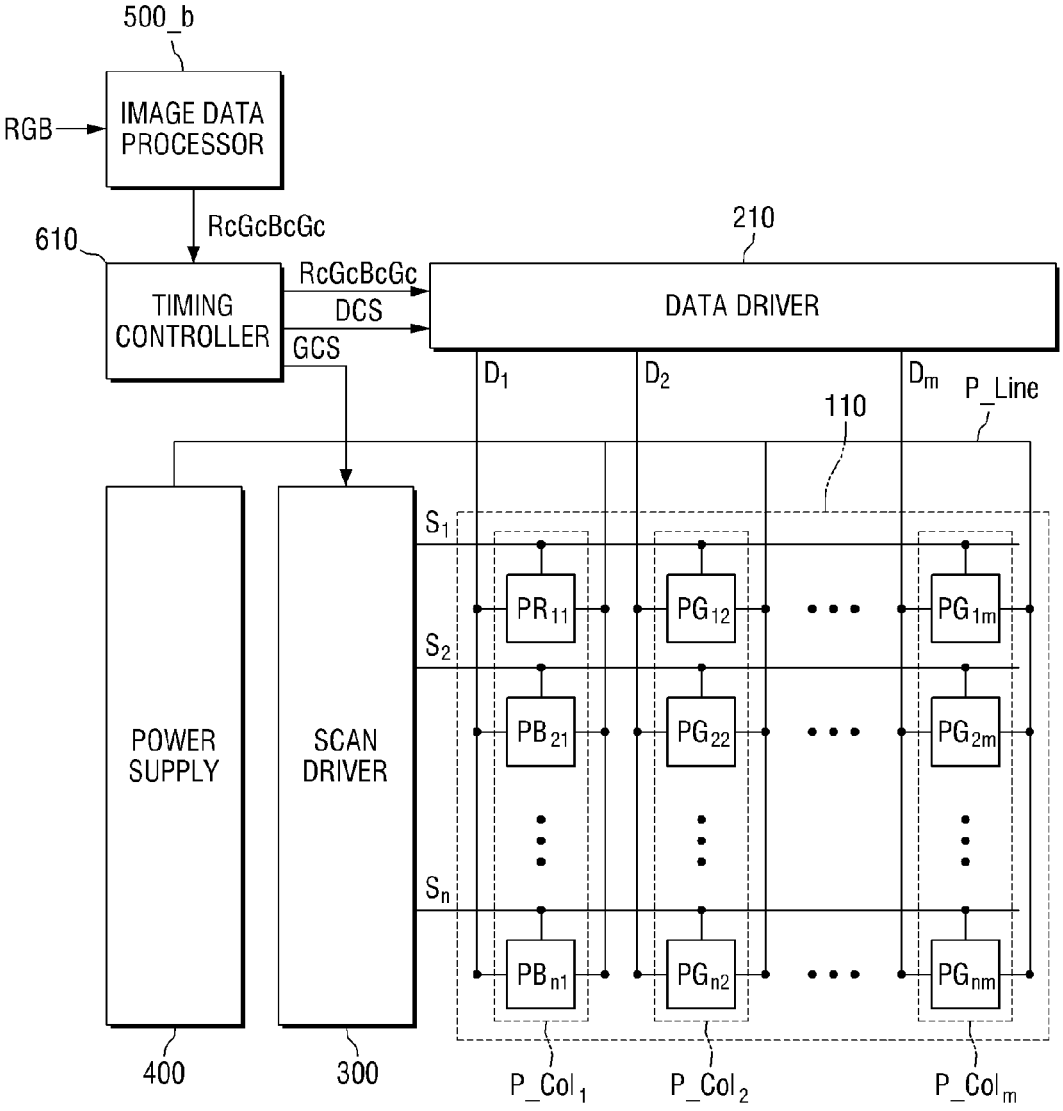
FIG. 7 is a block diagram of a display apparatus according to some embodiments.

FIG. 7 is a block diagram of a display apparatus according to some embodiments.

The display apparatus shown in FIG. 7 is different from the display apparatus of FIG. 1 in that a plurality of pixels of a display panel 110 are arranged in a PenTile® type, and corrected input image signals (RcGcBcGc) output from an image data processor 500_*b*) are formed in 4 channels so as to correspond to the PenTile® type. In the following description, the components having substantially the same as those in the previous embodiment are denoted by the same reference symbols or numerals, and repeated descriptions thereof will be omitted.

In the display apparatus according to some embodiments, a plurality of pixel regions may include a first pixel array (P_Col1) in which first pixels configured to display a red color and third pixels configured to display a blue color alternately provided, a second pixel array (P_Col2) which is adjacent to the first pixel array (P_Col1) and in which second pixels configured to display a green color are provided in parallel, a third pixel array (not shown) which is adjacent to the second pixel array (P_Col2) and in which third pixels and the first pixels are alternately provided in the reverse order to the first pixels and the third pixels of the first pixel array (P_Col1), and a fourth pixel array (not shown) which is adjacent to the third pixel array and in which the second pixels are provided in parallel. In addition, the plurality of pixel regions may include a (M−3)th pixel array (not shown), a (M−2)th pixel array (not shown), a (M−1)th pixel array (not shown) and an Mth pixel array (P_Colm), which have pixels provided in the same manner as the first pixel array (P_Col1), the second pixel array (P_Col2), the third pixel array and the fourth pixel array, respectively. Accordingly, the display panel 110 may include the plurality of pixel regions arranged in a PenTile® type in which red, green, blue and green pixels are repeatedly provided in a scan line direction.

Figure 8:
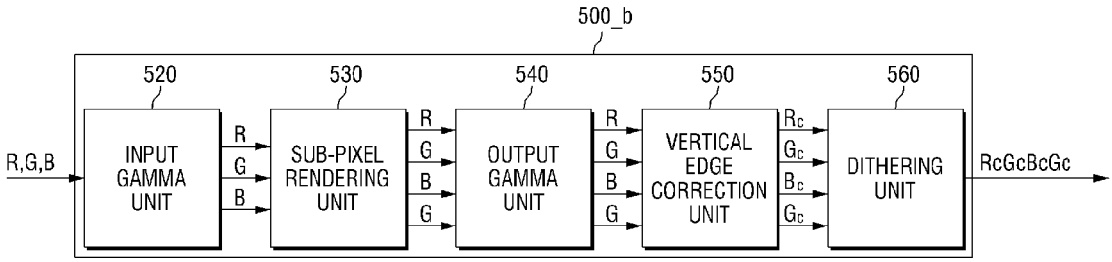
FIG. 8 is a block diagram of an image data processor (500_*b*) in a display apparatus according to some embodiments.

FIG. 8 is a block diagram of an image data processor (500_*b*) in a display apparatus according to some embodiments.

Referring to FIG. 8, in the display apparatus according to some embodiments, the image data processor 500_*b* may include an input gamma unit 520, a sub-pixel rendering unit 530, an output gamma unit 540, a vertical edge processor 550 and a dithering unit 560.

The input gamma unit 520 may output a red input gamma value (R), a green input gamma (G) value and a blue input gamma (B) value corresponding to input image signals (RGB) applied thereto, respectively.

The sub-pixel rendering unit 530 may output 4-channel image signals including combinations of the red input gamma value (R), the green input gamma (G) value, the blue input gamma (B) value and the green input gamma (G) value with gamma values of surrounding pixels, so that the red input gamma value (R), the green input gamma (G) value, the blue input gamma (B) value and the green input gamma (G) value, which are output from the input gamma unit 520, are applied to a PenTile® type display panel 100.

The output gamma unit 540 outputs output gamma values corresponding to the 4-channel image signals, including the red input gamma value (R), the green input gamma (G) value, the blue input gamma (B) value and the green input gamma (G) value, which are output from the input gamma unit 520, respectively.

The vertical edge processor 550 may process the output gamma values output from the output gamma unit 540 to then output corrected input image signals (RcGcBcGc) to adjust gray values applied to the first pixel array (P_Col1) and the Mth pixel array (P_Colm).

The dithering unit 560 may dither the corrected input image signals (RcGcBcGc) to then output the same and may supply the output signals to the timing controller 600.

Figure 9:
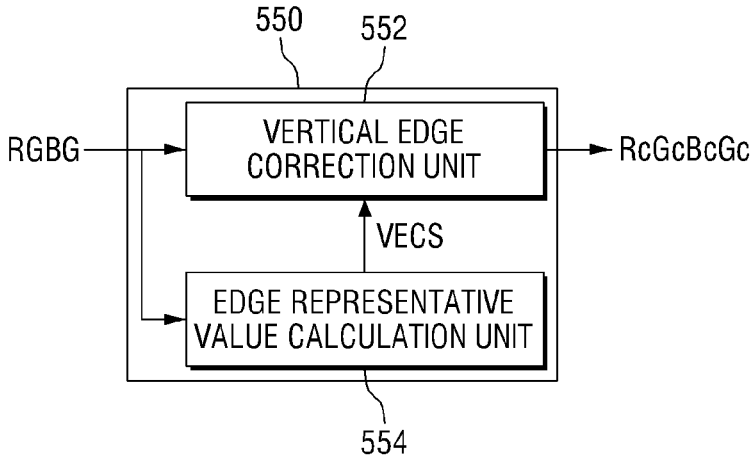
FIG. 9 is a block diagram of a vertical edge processor (550) in a display apparatus according to some embodiments.
Figure 10:
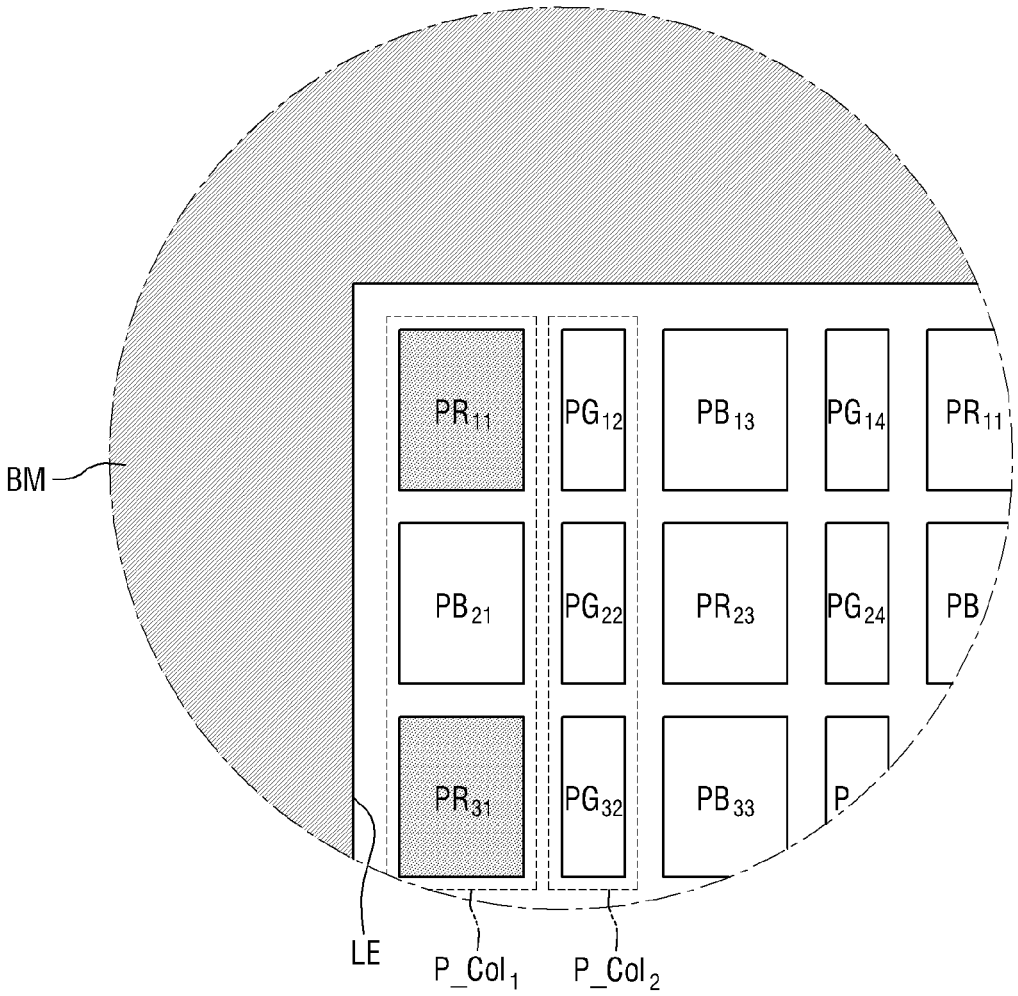
FIG. 10 is an enlarged cross-sectional view of area A3 of FIG. 3 in a display apparatus according to some embodiments.
Figure 11:
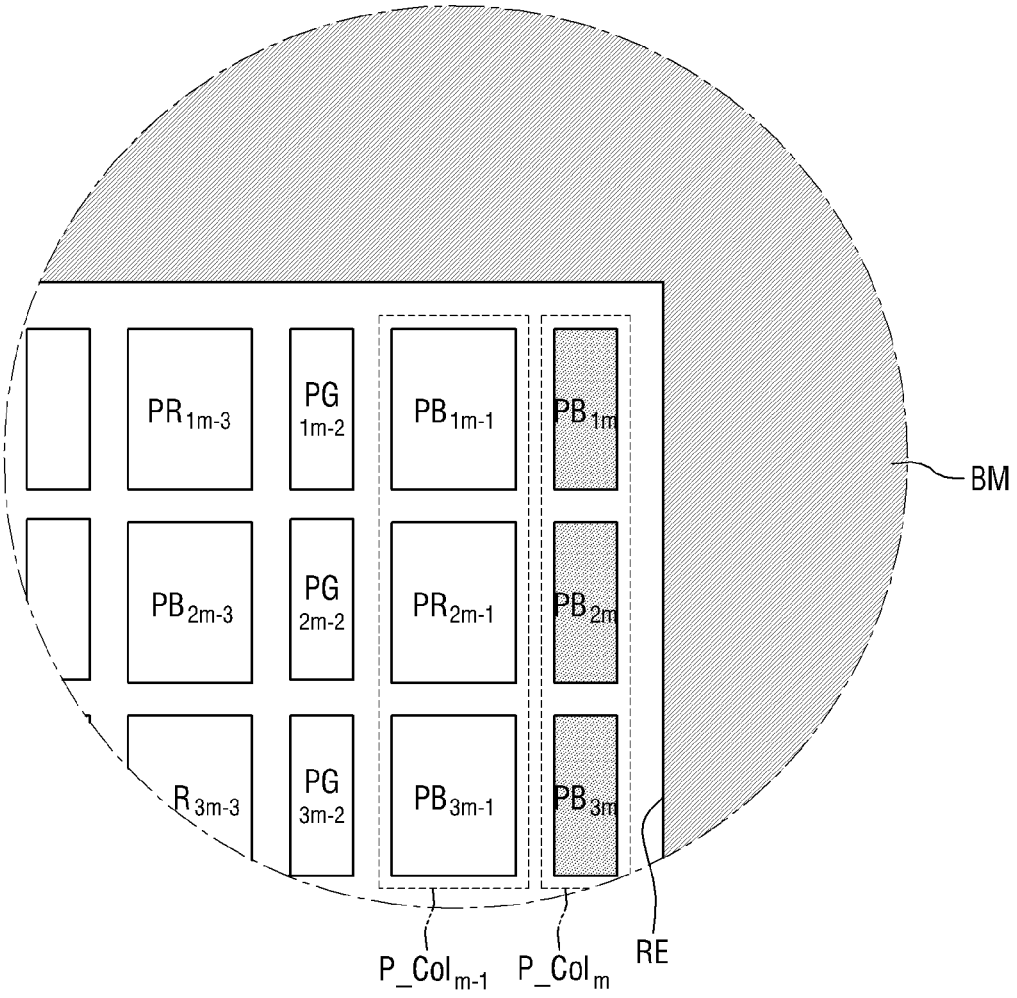
FIG. 11 is an enlarged cross-sectional view of area A4 of FIG. 3 in a display apparatus according to some embodiments.

FIG. 9 is a block diagram of a vertical edge processor 550 in a display apparatus according to some embodiments, FIG. 10 is an enlarged cross-sectional view of area A3 of FIG. 3 in a display apparatus according to some embodiments, and FIG. 11 is an enlarged cross-sectional view of area A4 of FIG. 3 in a display apparatus according to some embodiments.

Referring to FIG. 9, in the display apparatus according to some embodiments, the image data processor 500_*b* is different from the image data processor 500 according to the previous embodiment of the present invention in that a vertical edge processor 550 receives 4-channel input image signals (RGBG) corresponding to a PenTile® type and outputs 4-channel corrected input image signals (RcGcBcGc).

In the following description, the components having substantially the same as those in the previous embodiment are denoted by the same reference symbols or numerals, and repeated descriptions thereof will be omitted.

Referring to FIGS. 3, 10 and 11, with respect to the input image signals (RGB) corresponding to the display image (IMAGE) shown in FIG. 3, the edge representative value calculation unit 554 may calculate the average gray value of the first edge area (A1) and the average gray value of the second edge area (A2), may determine whether the first edge area (A1) and the second edge area (A2) of the display image (IMAGE) shown in FIG. 3 are fully white images or gray colored images exceeding a predetermined critical gray value, and may output a vertical edge control signal (VECS) according to the determination result.

The vertical edge correction unit 552 receives the vertical edge control signal (VECS) and outputs the corrected input image signals (RcGcBc) to adjust a gray value applied to the first pixel array (P_Col1) adjacent to the left edge (LE), which is then applied to the data line of the first pixel array (P_Col1) via the data driver 200, thereby adjusting the gray level of the first pixel array (P_Col1).

The vertical edge correction unit 552 analyzes continuously received input image signals (RGB) and determines whether the corresponding input image signals (RGBG) are output from the first pixel array (P_Col1) or from the Mth pixel array (P_Colm). In detail, the vertical edge correction unit 552 may analyze an image corresponding to one horizontal period of one frame, may extract the input image signal corresponding to the first pixel of one horizontal period and the input image signal corresponding to the last pixel of one horizontal period, and may determine whether the extracted input image signal is an image signal of the first pixel array (P_Col1) or an image signal of the Mth pixel array (P_Colm)

based on the input direction of the input image signals (RGB). For example, when the input image signals (RGBG) are signals received in the order from the left top end to the right bottom end of the display panel 100, the first image signal of one frame may be extracted as the image signal of the first pixel array (P_Col1), and the last first image signal of one frame may be extracted as the image signal of the Mth pixel array (P_Colm).

The vertical edge correction unit 552 may adjust only the gray level of a particular pixel of the first pixel array (P_Col1) based on the manner how a plurality of pixels ($PR_{11}$, . . . , $PG_{nm}$) of the display panel 110 are provided.

For example, as shown in FIG. 10, when the first pixel array (P_Col1) has first pixels configured to display a red color and third pixels configured to display a blue color are alternately provided, the vertical edge correction unit 552 may adjust gray levels such that the gray value applied to the first pixels displaying a relatively bright color may become smaller than the gray value applied to the third pixels.

Accordingly, since the first pixels that are configured to display a red color are brighter than the third pixels that are configured to display a blue color, it is possible to prevent a phenomenon that the first pixel array (P_Col1) adjacent to the left edge (LE) of the black matrix (BM) are perceived as red striped patterns by adjusting the gray levels of the first pixels of the first pixel array (P_Col1) to be lower than the gray levels of the third pixels.

As shown in FIG. 11, the vertical edge correction unit 552 receives a vertical edge control signal (VECS) and outputs corrected input image signals (RcGcBcGc) to adjust the gray value applied to the Mth pixel array (P_Colm) adjacent to the right edge (RE), which is applied to the data line of the Mth pixel array (P_Colm) via the data driver 200, thereby adjusting the gray level of the Mth pixel array (P_Colm) and preventing the Mth pixel array (P_Colm) from being perceived as green striped patterns.

According to some embodiments, the plurality of pixels are arranged in a PenTile®$_{type}$ in which RGBG pixels are repeatedly arranged, but aspects of the present invention are not limited thereto. For example, the present invention may also be applied to the display panel 100 of an RGBW PenTile® type in which red, green, blue and white pixels are repeatedly arranged. In this case, the vertical edge correction unit 552 may adjust relative gray levels of the green and white pixels of the Mth pixel array (P_Colm).

According to some embodiments, a display apparatus having improved display quality is disclosed.

According to an aspect of the present invention, there is provided a display apparatus including a display panel including first to Mth data lines extending in a first direction, where M is an integer greater than 2, first to Nth data lines extending in a second direction, where N is an integer greater than 2, and a plurality of pixel regions defined by one or more of the data lines and one or more of the scan lines, an image data processor processing input image signals and outputting corrected input image signals, and a data driver receiving the corrected input image signals and supplying the same to the first to Mth data lines, wherein the plurality of pixel regions include first to Mth pixel arrays in which pixel arrays defined by N pixel regions arrayed in parallel in the first direction are sequentially arrayed in parallel in the second direction, and the image data signal processor outputs the corrected input image signals to adjust a gray value applied to the first pixel array.

According to another aspect of the present invention, there is provided a display apparatus including a display panel including first to Mth data lines extending in a first direction, where M is an integer greater than 2, first to Nth data lines extending in a second direction, where N is an integer greater than 2, and a plurality of pixel regions defined by one or more of the data lines and one or more of the scan lines, an image data processor processing input image signals and outputting corrected input image signals, and a data driver receiving the corrected input image signals and supplying the same to the first to Mth data lines, wherein the plurality of pixel regions include first to Mth pixel arrays in which pixel arrays defined by N pixel regions arrayed in parallel in the first direction are sequentially arrayed in parallel in the second direction, and the image data signal processor outputs the corrected input image signals to adjust a gray value applied to the Mth pixel array.

According to still another aspect of the present invention, there is provided a display apparatus including a display panel including first to Mth data lines extending in a first direction, where M is an integer greater than 2, first to Nth data lines extending in a second direction, where N is an integer greater than 2, and a plurality of pixel regions defined by one or more of the data lines and one or more of the scan lines, an image data processor processing input image signals and outputting corrected input image signals, and a data driver receiving the corrected input image signals and supplying the same to the first to Mth data lines, wherein the plurality of pixel regions include first to Mth pixel arrays in which pixel arrays defined by N pixel regions arrayed in parallel in the first direction are sequentially arrayed in parallel in the second direction, and the image data signal processor outputs the corrected input image signals to adjust gray values applied to the first to Mth pixel arrays.

According to a further aspect of the present invention, there is provided a display apparatus including a display panel including first to Mth data lines extending in a first direction, where M is an integer greater than 2, first to Nth data lines extending in a second direction, where N is an integer greater than 2, and a plurality of pixel regions defined by one or more of the data lines and one or more of the scan lines, an image data processor processing input image signals and outputting corrected input image signals, a data driver receiving the corrected input image signals and supplying the same to the first to Mth data lines, a first voltage adjusting unit connected to the first data line between the data driver and the plurality of pixel regions, and a second voltage adjusting unit connected to the Mth data line between the data driver and the plurality of pixel regions, wherein the plurality of pixel regions include first to Mth pixel arrays in which pixel arrays defined by N pixel regions arrayed in parallel in the first direction are sequentially arrayed in parallel in the second direction, the image data signal processor outputs a first vertical edge control signal to adjust a gray value applied to the first pixel array and a second vertical edge control signal to adjust a gray value applied to the Mth pixel array, the first voltage adjusting unit receives the first vertical edge control signal and adjusts a gray voltage of the first data line, the second voltage adjusting unit receives the second vertical edge control signal and adjusts a gray voltage of the Mth data line.

While the present invention has been particularly shown and described with reference to exemplary embodiments thereof, it will be understood by those of ordinary skill in the art that various changes in form and details may be made therein without departing from the spirit and scope of the present invention as defined by the following claims. It is therefore desired that the present embodiments be considered in all respects as illustrative and not restrictive, reference being made to the appended claims rather than the foregoing description to indicate the scope of the invention.

What is claimed is:

1. A display apparatus comprising:

a display panel comprising first to Mth data lines extending in a first direction, where M is an integer greater than 2, first to Nth scan lines extending in a second direction, where N is an integer greater than 2, and a plurality of pixel regions defined by one or more of the data lines and one or more of the scan lines;

an image data processor configured to process input image signals and output corrected input image signals; and a data driver configured to receive the corrected input image signals and supply the corrected input image signals to the data lines, wherein the plurality of pixel regions include first to Mth pixel arrays extending in parallel, and the image data signal processor is configured to output the corrected input image signals to adjust a gray value applied to the first pixel array, wherein each of the pixel arrays comprises a plurality of pixels formed in a single column, wherein the image data processor includes an edge representative value calculator configured to analyze the input image signals and output a vertical edge control signal, and a vertical edge corrector configured to output the corrected input image signals to adjust a gray value applied to the first pixel array in response to the vertical edge control signal, and wherein the display panel includes a black matrix surrounding the pixel regions, wherein the first pixel array is located at the leftmost column of the pixel regions, wherein the Mth pixel array is located at the rightmost column of the pixel regions, and wherein the edge representative value calculator is further configured to output the vertical edge control signal based on the average gray value of only the pixels of the first pixel array.

2. The display apparatus of claim 1, wherein the image data processor is configured to output the corrected input image signals to adjust gray values applied to the first pixel array and the Mth pixel array.

3. The display apparatus of claim 1, wherein the (M−2)th pixel array comprises first pixels configured to display a first color, the (M−1)th pixel array comprises second pixels configured to display a second color, and the Mth pixel array comprises third pixels configured to display a third color.

4. The display apparatus of claim 1, wherein the (M−1)th pixel array comprises first pixels configured to display a first color and second pixels configured to display a second color alternately arranged, where M is an integer greater than 3, and the Mth pixel array has third pixels configured to display a third color.

5. The display apparatus of claim 4, wherein the image data processor is configured to output the corrected input image signals to adjust gray values such that the gray value applied to the first pixels of the first pixel array is smaller than the gray value applied to the second pixels of the first pixel array.

6. The display apparatus of claim 5, wherein the first color is red and the second color is blue.

7. The display apparatus of claim 1, wherein the (M−1)th pixel array comprises first pixels configured to display a first color and second pixels configured to display a second color alternately arranged, where M is an integer greater than 3, and the Mth pixel array has third pixels configured to display a third color and fourth pixels configured to display a fourth color alternately arranged.

8. The display apparatus of claim 1, wherein the edge representative value calculator is configured to generate the vertical edge control signal having i) a minimum value when the average gray value in the first edge area is a gray colored image having a predetermined gray value, and ii) having a maximum value when the average gray value in the first edge area is a fully white colored image.

9. A display apparatus comprising:

a display panel comprising first to Mth data lines extending in a first direction, where M is an integer greater than 2, first to Nth scan lines extending in a second direction, where N is an integer greater than 2, and a plurality of pixel regions defined by one or more of the data lines and one or more of the scan lines;

an image data processor configured to process input image signals and output corrected input image signals; and a data driver configured to receive the corrected input image signals and supply the corrected input image signals to the data lines, wherein the plurality of pixel regions include first to Mth pixel arrays extending in parallel, and the image data signal processor is configured to output the corrected input image signals to adjust a gray value applied to the Mth pixel array, wherein each of the pixel arrays comprises a plurality of pixels formed in a single column, wherein the image data processor includes an edge representative value calculator configured to analyze the input image signals and output a vertical edge control signal, and a vertical edge corrector configured to output the corrected input image signals to adjust a gray value applied to the Mth pixel array in response to the vertical edge control signal, and wherein the display panel includes a black matrix region surrounding the pixel regions, wherein the first pixel array is located at the leftmost column of the pixel regions, wherein the Mth pixel array is located at the rightmost column of the pixel regions, and wherein the edge representative value calculator is further configured to output the vertical edge control signal based on the average gray value of only the pixels of the Mth pixel array.

10. The display apparatus of claim 9, wherein the (M−2)th pixel array has first pixels configured to display a first color, the (M−1)th pixel array has second pixels configured to display a second color, and the Mth pixel array has third pixels configured to display a third color.

11. The display apparatus of claim 10, wherein the image data processor is configured to output the corrected input image signals to adjust gray values such that the gray value applied to the third pixels of the Mth pixel array is smaller than the gray value applied to the first and second pixels of the (M−1)th pixel array.

12. The display apparatus of claim 11, wherein the third color is green.

13. The display apparatus of claim 9, wherein the (M−1)th pixel array has the first pixels configured to display the first color and the second pixels configured to display the second color alternately arranged, where M is an integer greater than 3, and the Mth pixel array has third pixels configured to display a third color and fourth pixels configured to display a fourth color alternately arranged.

14. A display apparatus comprising:

a display panel comprising first to Mth data lines extending in a first direction, where M is an integer greater than 2, first to Nth scan lines extending in a second direction, where N is an integer greater than 2, and a plurality of pixel regions defined by one or more of the data lines and one or more of the scan lines;

an image data processor configured to process input image signals and output corrected input image signals; and a data driver configured to receive the corrected input image signals and supply the corrected input image signals to the data lines, wherein the plurality of pixel regions include first to Mth pixel arrays extending in parallel, and the image data signal processor is configured to output the corrected input image signals to adjust gray values applied to the first to Mth pixel arrays, wherein each of the pixel arrays comprises a plurality of pixels formed in a single column, wherein the image data processor includes an edge representative value calculator configured to analyze the input image signals and output a vertical edge control signal, and a vertical edge corrector configured to output the corrected input image signals to adjust a gray value applied to the first pixel array in response to the vertical edge control signal, and wherein the display panel includes a black matrix surrounding the pixel regions, wherein the first pixel array is located at the leftmost column of the pixel regions, wherein the Mth pixel array is located at the rightmost column of the pixel regions, and wherein the edge representative value calculator is further configured to output the vertical edge control signal based on the average gray value of only the pixels of the first pixel array.

15. The display apparatus of claim 14, wherein the (M−1)th pixel array has first pixels configured to display a first color and second pixels configured to display a second color alternately arrayed, where M is an integer greater than 3, and the Mth pixel array has third pixels configured to display a third color.

16. The display apparatus of claim 15, wherein the first color is red, the second color is blue and the third color is green.

17. A display apparatus comprising:

a display panel comprising first to Mth data lines extending in a first direction, where M is an integer greater than 2, first to Nth scan lines extending in a second direction, where N is an integer greater than 2, and a plurality of pixel regions defined by one or more of the data lines and one or more of the scan lines;

an image data processor configured to process input image signals and output corrected input image signals;

a data driver configured to receive the corrected input image signals and supply the corrected input image signals to the data lines;

a first voltage adjusting unit connected to the first data line between the data driver and the plurality of pixel regions; and a second voltage adjusting unit connected to the Mth data line between the data driver and the plurality of pixel regions, wherein the plurality of pixel regions include first to Mth pixel arrays extending in parallel, and the image data signal processor is configured to output a first vertical edge control signal to adjust a gray value applied to the first pixel array and a second vertical edge control signal to adjust a gray value applied to the Mth pixel array, the first voltage adjusting unit is configured to receive the first vertical edge control signal and adjust a gray voltage of the first data line, the second voltage adjusting unit is configured to receive the second vertical edge control signal and adjust a gray voltage of the Mth data line, wherein each of the pixel arrays comprises a plurality of pixels formed in a single column, wherein the image data processor includes an edge representative value calculator configured to analyze the input image signals and output a vertical edge control signal, and a vertical edge corrector configured to output the corrected input image signals to adjust a gray value applied to the first pixel array in response to the vertical edge control signal, and wherein the display panel includes a black matrix surrounding the pixel regions, wherein the first pixel array is located at the leftmost column of the pixel regions, wherein the Mth pixel array is located at the rightmost column of the pixel regions, and wherein the edge representative value calculator is further configured to output the vertical edge control signal based on the average gray value of only the pixels of the first pixel array.

* * * * *